US010668934B2

(12) United States Patent
Li et al.

(10) Patent No.: US 10,668,934 B2
(45) Date of Patent: Jun. 2, 2020

(54) ROOF COMPONENT OF RAILWAY VEHICLE, AND RAILWAY VEHICLE

(71) Applicant: CRRC QINGDAO SIFANG CO., LTD., Qingdao (CN)

(72) Inventors: Yang Li, Qingdao (CN); Haiyang Yu, Qingdao (CN); Bo Song, Qingdao (CN); Honglei Tian, Qingdao (CN)

(73) Assignee: CRRC QINGDAO SIFANG CO., LTD., Qingdao (CN)

( * ) Notice: Subject to any disclaimer, the term of this patent is extended or adjusted under 35 U.S.C. 154(b) by 0 days.

(21) Appl. No.: 16/189,136

(22) Filed: Nov. 13, 2018

(65) Prior Publication Data

US 2019/0077421 A1 Mar. 14, 2019

(30) Foreign Application Priority Data

Sep. 6, 2018 (CN) ..... 2018 2 1461017 U

(51) Int. Cl.

*B61D 17/12* (2006.01)
*E04B 7/02* (2006.01)
*B61D 17/04* (2006.01)

(52) U.S. Cl.

CPC ..... *B61D 17/12* (2013.01); *B61D 17/045* (2013.01); *E04B 7/026* (2013.01)

(58) Field of Classification Search

CPC ..... B61D 17/045; B61D 17/12; E04B 7/026; E04B 2001/249

See application file for complete search history.

(56) References Cited

U.S. PATENT DOCUMENTS 1,937,309 A * 11/1933 Bonsall ..... B61D 17/12 52/17
2,034,377 A * 3/1936 Bonsall ..... B61D 17/12 52/17
2,034,379 A * 3/1936 Bonsall ..... B61D 17/12 52/17
2,034,382 A * 3/1936 Bonsall ..... B61D 17/12 52/17
2,645,521 A * 7/1953 Judson ..... B62D 25/06 296/185.1
7,648,190 B2 * 1/2010 Timmermans ..... B62D 25/06 296/178
8,141,498 B2 * 3/2012 Barr ..... B61D 17/12 105/396
9,021,703 B2 * 5/2015 Garceau ..... B62D 25/06 29/521

(Continued)

*Primary Examiner* — Beth A Stephen
(74) *Attorney, Agent, or Firm* — Cantor Colburn LLP

(57) ABSTRACT

Some embodiments of the present disclosure provide a roof component of a railway vehicle, and a railway vehicle. The roof component of a railway vehicle includes: two upper boundary beams, the two upper boundary beams being provided at an interval; a camber beam component, the camber beam component being provided between the two upper boundary beams; and a transitional structure, provided on the camber beam component, the transitional structure being connected with at least one of the two upper boundary beams. The technical solution of the present disclosure solves the problem in the conventional art of inconvenient connection between a camber beam component and an upper boundary beam, and a transitional structure of the present application facilitates processing and forming.

20 Claims, 3 Drawing Sheets

(56) References Cited

U.S. PATENT DOCUMENTS

| | | | | |
|---|---|---|---|---|
| 9,932,049 | B2 * | 4/2018 | Kato | B61D 17/045 |
| 2016/0001789 | A1 * | 1/2016 | Kato | B61D 17/045<br>105/396 |

* cited by examiner

ROOF COMPONENT OF RAILWAY VEHICLE, AND RAILWAY VEHICLE

CROSS REFERENCE TO RELATED APPLICATION

This application is related to and claims the benefit of Chinese Patent Application No. 201821461017.7 filed on Sep. 6, 2018, the contents of which are herein incorporated by reference in their entirety.

TECHNICAL FIELD

The present disclosure relates to a field of railway vehicles, and in particular to a roof component of a railway vehicle, and a railway vehicle.

BACKGROUND

A railway vehicle includes a roof component and a side wall component connected with the roof component. The roof component includes a roof bending beam and an upper boundary beam for supporting, and a roof body covering the bending beam and the upper boundary beam.

According to an upper boundary beam structure of the railway vehicle in the related art, a recess portion is pressed against an upper end of the back of the upper boundary beam, and is lapped with an extending edge of the lower end of the roof bending beam. However, since the overall length size of the upper boundary beam is large, the upper boundary beam does not facilitate forming during the processing of the recess portion. Moreover, the overall errors are difficult to control, and the processing accuracy is difficult to master. Therefore, the arrangement mode does not facilitate processing, and thus the connecting accuracy between the roof bending beam and the upper boundary beam is difficult to control.

SUMMARY

Some embodiments of the present disclosure provide a roof component of a railway vehicle and a railway vehicle, and solve the problem in the related art of inconvenient connection between a camber beam component and an upper boundary beam.

An exemplary embodiment of the present disclosure provides a roof component of a railway vehicle, the roof component includes: two upper boundary beams, the two upper boundary beams being provided at an interval; a camber beam component, the camber beam component being provided between the two upper boundary beams; and a transitional structure, provided on the camber beam component, the transitional structure being connected with at least one of the two upper boundary beams.

Some embodiments of the present disclosure provide a railway vehicle. The railway vehicle includes a roof component and a side wall component connected with the roof component, the roof component being the above roof component.

By adopting the technical solution of the present disclosure, since the transitional structure is provided on the camber beam component, connection between the camber beam component and the upper boundary beam is facilitated, thus ensuring the overall strength of the roof component. Compared with the related art in which the transitional structure is provided on the upper boundary beam, the transitional structure of the embodiment in the present disclosure is provided on the camber beam component. Since the width size of the roof component is much smaller than the length size of the roof component, the transitional structure of the embodiment facilitates processing, the processing size and accuracy are easy to control, and the problem of inconvenient forming of the transitional structure caused by a large overall length size of the upper boundary beam is solved. The arrangement facilitates connection between the camber beam component and the upper boundary beam, and solves the problem in the related art of inconvenient connection between the camber beam component and the upper boundary beam. In addition, the transitional structure of the present application facilitates processing and forming.

BRIEF DESCRIPTION OF THE DRAWINGS

The accompanying drawings, which constitute a part of the present application, are used to provide a further understanding of the present disclosure, and the exemplary embodiments of the present disclosure and the description thereof are used to explain the present disclosure, but do not constitute improper limitations to the present disclosure. In the drawings.

The drawings include the following reference signs:

90: roof component; 91: roof body; 92: upper boundary beam; 921: first upper boundary beam segment; 922: second upper boundary beam segment; 923: water groove; 94: camber beam component; 941: end camber beam; 9411: first end camber beam segment; 9412: second end camber beam segment; 942: middle camber beam; 9421: first connecting beam; 9422: second connecting beam; 9423: third connecting beam; 943: transitional beam; 944: inserted-connected portion.

DETAILED DESCRIPTION OF THE EMBODIMENTS

It is to be noted that in the case of no conflict, the features in the embodiments and the embodiments in the present application may be combined with each other. The present disclosure is described below with reference to the drawings and in conjunction with the embodiments in detail.

Figure 1:
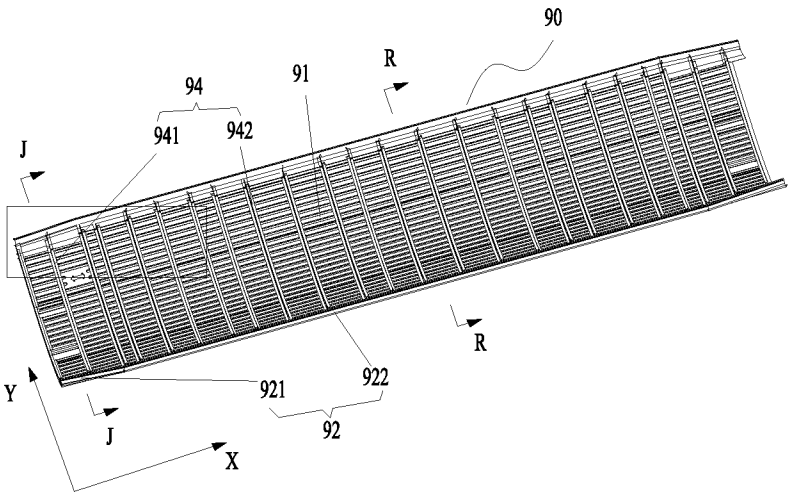
FIG. 1 illustrates a structural schematic diagram of a roof component of a railway vehicle according to an embodiment of the present disclosure.

The length direction and width direction of a roof component in the present disclosure are as shown in FIG. 1, an X direction is the length direction of the roof component, and a Y direction is the width direction of the roof component.

Figure 2:
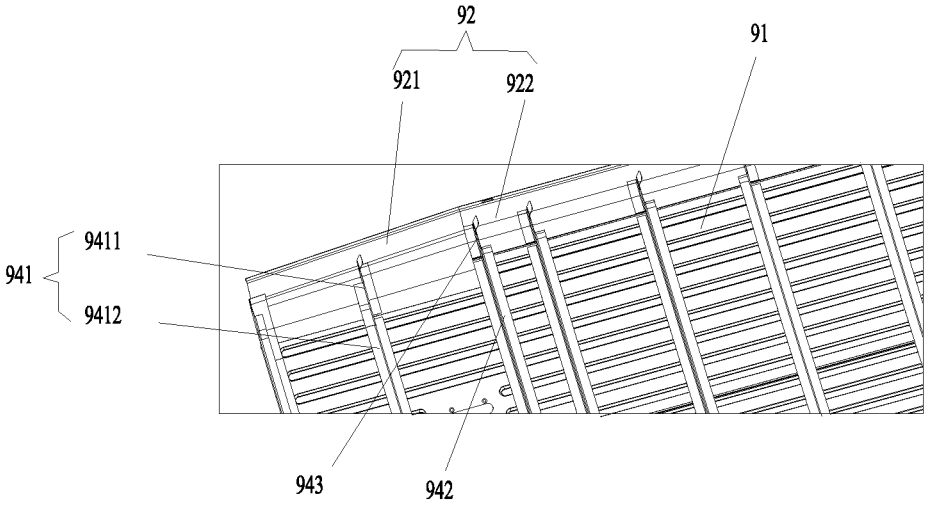
FIG. 2 illustrates a partial enlarged schematic diagram of the roof component in FIG. 1.

As shown in FIG. 1 and FIG. 2, an embodiment of the present disclosure provides a roof component of a railway vehicle. The roof component of the embodiment includes two upper boundary beams 92 which are provided at an interval, a camber beam component 94 and a transitional structure. The camber beam component 94 is provided between the two upper boundary beams 92. The transitional structure is provided on the camber beam component 94, the transitional structure is connected with at least one of the two upper boundary beams 92.

In the embodiment of the present disclosure, since the transitional structure is provided on the camber beam component 94, connection between the camber beam component 94 and the upper boundary beam 92 is facilitated, thus ensuring the overall strength of the roof component 90. Compared with the related art in which the transitional structure is provided on the upper boundary beam 92, the transitional structure of the embodiment is provided on the camber beam component 94. Since a width size of the roof component 90 is much smaller than a length size of the roof component 90, the transitional structure of the embodiment of the present disclosure facilitates processing, the processing size and accuracy are easy to control, and the problem of inconvenient forming of the transitional structure caused by a large overall length size of the upper boundary beam 92 is solved. The embodiment facilitates connection between the camber beam component 94 and the upper boundary beam 92, and solves the problem in the related art of inconvenient connection between the camber beam component 94 and the upper boundary beam 92. In addition, the transitional structure provided on the camber beam component 94 in an embodiment of the present disclosure facilitates processing and forming.

As shown in FIG. 1 and FIG. 2, in an exemplary embodiment of the present disclosure, each of the two upper boundary beams 92 includes two first upper boundary beam segments 921 and a second upper boundary beam segment 922 connecting the two first upper boundary beam segments 921, and the camber beam component 94 includes a plurality of middle camber beams 942 and a plurality of end camber beams 941. Each of the plurality of middle camber beams 942 is connected with the second upper boundary beam segment 922, and each of the plurality of end camber beams 941 is connected with the first upper boundary beam segment 921, wherein the plurality of end camber beams 941 and the plurality of middle camber beams 942 are provided along the length direction of each of the two upper boundary beams 92 at an interval, and the transitional structure is provided on each of the plurality of middle camber beams 942.

In an exemplary embodiment, each of the upper boundary beams 92 includes two first upper boundary beam segments 921 and a second upper boundary beam segment 922 connecting the two first upper boundary beam segments 921, the second upper boundary beam segment 922 is a flat structure, that is, a distance between two second upper boundary beam segments 922 is a same along the length direction of the vehicle body. In an exemplary embodiment, the middle camber beam 942 and the second upper boundary beam segment 922 are connected, and the transitional structure is provided on each of the plurality of middle camber beams 942.

In an exemplary embodiment, the camber beam component 94 includes a plurality of middle camber beams 942, the plurality of middle camber beams 942 are provided along the length direction of the upper boundary beam 92 at an interval. Since the distance between the two second upper boundary beam segments 922 is the same, the same transitional structure may be provided on each of the middle camber beams 942, that is, the connection between each of the middle camber beams 942 and the second upper boundary beam segment 922 can be realized. Moreover, in an exemplary embodiment of the present disclosure, the number of middle camber beams 942 is much greater than the number of end camber beams 941. Therefore, by providing the transitional structure on the middle camber beam 942, the connection between the camber beam component 94 and the upper boundary beam 92 is facilitated, and the transitional structures can be produced in batches, thereby facilitating processing.

In an exemplary embodiment, the transitional structure is a transitional beam 943 provided at one end of the each of the plurality of middle camber beam 942.

In an exemplary embodiment, the transitional beam 943 and the middle camber beam 942 are integrated molding structure.

In an exemplary embodiment, the transitional beam is provided at one end of the each of the plurality of middle camber beams 942, so as to facilitate the connection between the camber beam component 94 and the upper boundary beam 92. The transitional beam 943 and the middle camber beam 942 are integrated molding structure, so that the connecting strength between the transitional beam 943 and the middle camber beam 942 is ensured, thus ensuring the connecting strength between the camber beam component 94 and the upper boundary beams 92. Moreover, the transitional beam 943 is convenient to form, thereby facilitating processing.

Figure 3:
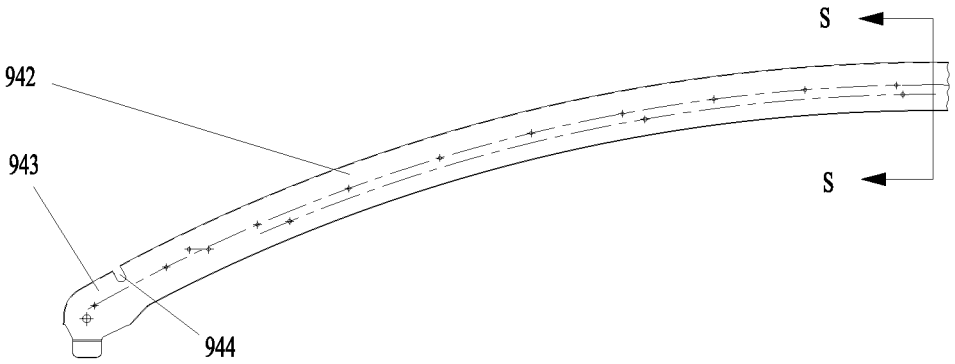
FIG. 3 illustrates a structural schematic diagram of a middle camber beam of the roof component in FIG. 1.

As shown in FIG. 3, in an exemplary embodiment of the present disclosure, the camber beam component 94 further includes an inserted-connected portion 944, a first end of the second upper boundary beam segment 922 is inserted into the inserted-connected portion 944, wherein the inserted-connected portion 944 is provided between the middle camber beam 942 and the transitional beam 943.

In an exemplary embodiment of the present disclosure, one end of the second upper boundary beam segment 922 is inserted into the inserted-connected portion 944, and after being in inserted fit with the inserted-connected portion 944, the second upper boundary beam segment 922 is welded to the transitional beam 943. The embodiment ensures the connecting strength between the second upper boundary beam segment 922 and the transitional beam 943.

Of course, in an alternative embodiment not illustrated in the drawings of the present disclosure, the inserted-connected portion 944 may be provided on the transitional beam 943 or the middle camber beam 942, as long as it can be ensured that the transitional beam 943 is in inserted fit with the second upper boundary beam segment 922.

Figure 5:
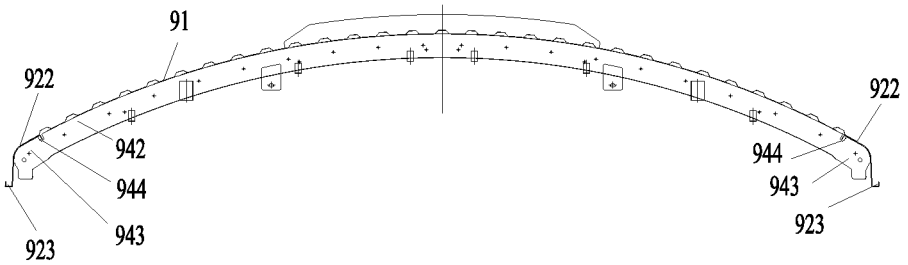
FIG. 5 illustrates an R-R direction sectional view of the roof component in FIG. 1.

As shown in FIG. 5, in an exemplary embodiment of the present disclosure, a water groove 923 is provided at a second end of the second upper boundary beam segment 922.

The embodiment may guide water flow on the roof component 90, so as to facilitate drainage of the vehicle, thereby avoiding from affecting an observation view of a window on the vehicle body caused by flowing of the water flow to the vehicle body of the railway vehicle along the roof component 90.

Figure 6:
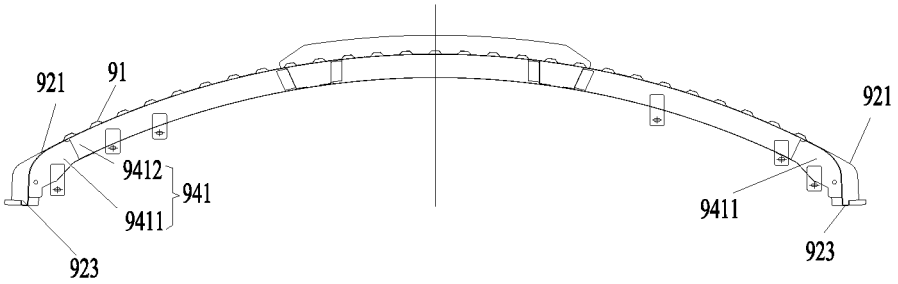
FIG. 6 illustrates a J-J direction sectional view of the roof component in FIG. 1.

In an exemplary embodiment, as shown in FIG. 6, a water groove 923 is also provided at a position, corresponding to the second end of the second upper boundary beam segment 922, of the each of the first upper boundary beam segments 921.

Figure 4:
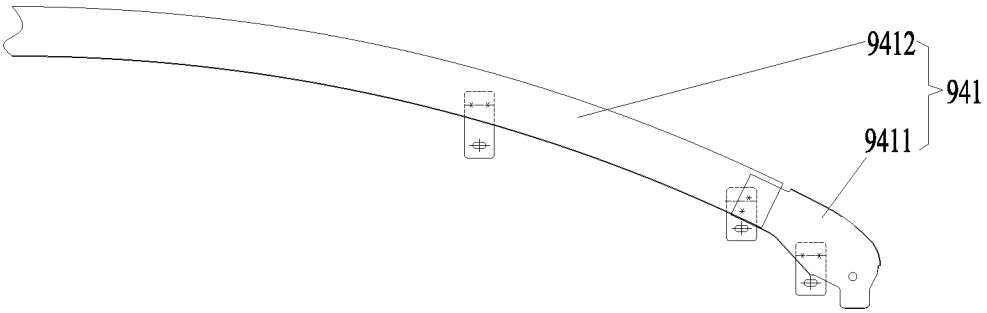
FIG. 4 illustrates a structural schematic diagram of an end camber beam of the roof component in FIG. 1.

As shown in FIG. 4, in an embodiment of the present disclosure, the end camber beam 941 includes two first end camber beam segments 9411 and one second end camber beam segment 9412. The two first end camber beam segments 9411 are correspondingly connected with the two first upper boundary beam segments 921, and the second end camber beam segment 9412 is located between the two first end camber beam segments 9411, each of the first end camber beam segments 9411 being fixedly connected with the second end camber beam segment 9412.

In an exemplary embodiment, the width size of the first upper boundary beam segment 921 is gradually increased along a direction extending from the end of the railway vehicle to the middle, that is, the first upper boundary beam segment 921 in the embodiment of the present disclosure is a structure where the section gradually changes.

The first end camber beam segments 9411 in the present disclosure are correspondingly connected with the first upper boundary beam segments 921, so as to realize the connection between the end camber beam 941 and the first upper boundary beam segment 921.

As shown in FIG. 6, in an exemplary embodiment of the present disclosure, at least one of the first upper boundary beam segments 921 is fixedly connected with one of the two first end camber beam segments 9411.

In an exemplary embodiment, the two first end camber beam segments 9411 are provided at two ends of the second end camber beam segment 9412, each of the first end camber beam segments 9411 is welded to the second end camber beam segment 9412, and the each of the first end camber beam segments 9411 is welded to the first upper boundary beam segments 921.

The embodiment ensures the connecting strength between the end camber beam 941 and the first upper boundary beam segment 921. The connecting strength between the transitional beam 943 and the second upper boundary beam segment 922 is high. Therefore, the connecting strength between the camber beam component 94 and the upper boundary beam 92 in the embodiment is good, and the connection is convenient, so that the overall structure strength of the roof component is ensured.

Figure 7:
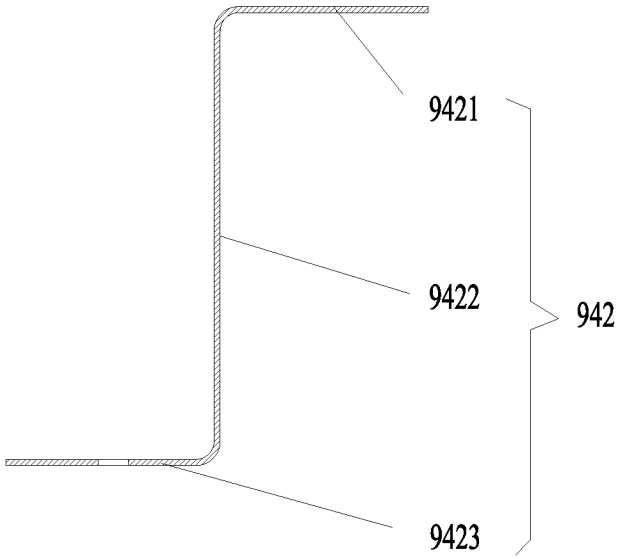
FIG. 7 illustrates an S-S direction sectional view of the middle camber beam in FIG. 3.

As shown in FIG. 7, in an exemplary embodiment of the present disclosure, sections of the middle camber beam 942 and/or the end camber beam 941 are Z-shaped along a width direction of the roof component.

In an exemplary embodiment, the sections of the middle camber beam 942 and the end camber beam 941 are Z-shaped.

As shown in FIG. 1, FIG. 5 and FIG. 6, in an exemplary embodiment of the present disclosure, the roof component further includes a roof body 91, the camber beam component 94 is used for supporting the roof body 91.

The middle camber beam 942 is taken as an example. The middle camber beam 942 includes a first connecting beam 9421, a second connecting beam 9422 and a third connecting beam 9423. The first connecting beam 9421 and the third connecting beam 9423 are provided in parallel, and located at two opposite sides of the second connecting beam 9422 respectively. The third connecting beam 9423 is fixedly connected with the roof body 91 of the roof component 90, the first connecting beam 9421 is used for mounting an interior member, and the second connecting beam 9422 provides a certain mounting space for the roof component 90.

In an exemplary embodiment, the section of the transitional beam 943 is also Z-shaped.

In the above embodiment, the structure strength is better, and the overall structure strength of the camber beam component 94 is ensured, thus ensuring the overall strength of the roof component 90.

In an exemplary embodiment, the roof body 91 is a corrugated plate structure.

The strength of the corrugated plate structure is better, thus ensuring the strength of the roof component 90.

An embodiment of the present disclosure also provides a railway vehicle. The railway vehicle includes a roof component 90 and a side wall component connected with the roof component, the roof component 90 is the above roof component.

The roof component 90 of an embodiment of the present disclosure includes a transitional structure, the transitional structure facilitates processing, the processing size and accuracy are easy to control, and the problem of inconvenient forming of the transitional structure caused by a large overall length size of the upper boundary beam 92 is solved. The embodiment facilitates connection between the camber beam component 94 and the upper boundary beam 92, and solves the problem in the related art of inconvenient connection between the camber beam component 94 and the upper boundary beam 92. In addition, the transitional structure provided on the camber beam component 94 in an embodiment of the present disclosure facilitates processing and forming. Therefore, the railway vehicle having the above roof component also has the above advantages.

From the above description, it can be seen that the embodiment of the present disclosure achieves the following technical effects: since the transitional structure is provided on the camber beam component, connection between the camber beam component and the upper boundary beam is facilitated, thus ensuring the overall strength of the roof component. Compared with the related art in which the transitional structure is provided on the upper boundary beam, the transitional structure of an embodiment of the present disclosure is provided on the camber beam component. Since the width size of the roof component is much smaller than the length size of the roof component, the transitional structure of the present disclosure facilitates processing, the processing size and accuracy are easy to control, and the problem of inconvenient forming of the transitional structure caused by a large overall length size of the upper boundary beam is solved. The embodiment of the present disclosure facilitates connection between the camber beam component and the upper boundary beam, and solves the problem in the related art of inconvenient connection between the camber beam component and the upper boundary beam. In addition, the transitional structure of the present disclosure facilitates processing and forming.

The above is only the preferred embodiments of the present disclosure, not intended to limit the present disclosure. As will occur to those skilled in the art, the present disclosure is susceptible to various modifications and changes. Any modifications, equivalent replacements, improvements and the like made within the spirit and principle of the present disclosure shall fall within the scope of protection of the present disclosure.

What is claimed is:

1. A roof component of a railway vehicle, comprising:

two upper boundary beams, the two upper boundary beams being provided at an interval; and a camber beam component, the camber beam component being provided between the two upper boundary beams; and a transitional structure, provided on the camber beam component, the transitional structure being connected with at least one of the two upper boundary beams;

wherein each of the two upper boundary beams comprises two first upper boundary beam segments and a second upper boundary beam segment connecting the two first upper boundary beam segments, wherein a width of the first upper boundary beam segments gradually increases along a length of the first upper boundary beam segments in a direction from opposing ends of the railway vehicle to a middle of the railway vehicle; and wherein a width of the second upper boundary beam segments is consistent along a length of the second upper boundary beam segments.

2. The roof component as claimed in claim 1, wherein the camber beam component comprises:

a plurality of middle camber beams, each of the plurality of middle camber beams being connected with the second upper boundary beam segment; and a plurality of end camber beams, each of the plurality of end camber beams being connected with a corresponding first upper boundary beam segment in the two first upper boundary beam segments, wherein the plurality of end camber beams and the plurality of middle camber beams are provided along a length direction of each of the two upper boundary beams at an interval, and the transitional structure is provided on each of the plurality of middle camber beams.

3. The roof component as claimed in claim 2, wherein the transitional structure is a transitional beam provided at one end of each of the plurality of middle camber beams.

4. The roof component as claimed in claim 3, wherein the camber beam component further comprises an inserted-connected portion, a first end of the second upper boundary beam segment being inserted into the inserted-connected portion, wherein the inserted-connected portion is provided on the transitional beam or, the inserted-connected portion is provided between each of the plurality of middle camber beams and the transitional beam.

5. The roof component as claimed in claim 3, wherein the transitional beam and each of the plurality of middle camber beams are an integrated molding structure.

6. The roof component as claimed in claim 4, wherein a water groove is provided at a second end of the second upper boundary beam segment.

7. The roof component as claimed in claim 2, wherein each of the plurality of end camber beams comprises:

two first end camber beam segments, the two first end camber beam segments being correspondingly connected with the two first upper boundary beam segments; and a second end camber beam segment, used for connecting the two first end camber beam segments, each of the two first end camber beam segments being fixedly connected with the second end camber beam segment.

8. The roof component as claimed in claim 7, wherein at least one of the two first upper boundary beam segments is fixedly connected with one of the two first end camber beam segments.

9. The roof component as claimed in claim 2, wherein sections of the middle camber beams and/or the end camber beams are Z-shaped along a width direction of the roof component.

10. The roof component as claimed in claim 1, further comprising a roof body, the camber beam component being used for supporting the roof body.

11. The roof component as claimed in claim 10, wherein the roof body is a corrugated plate structure.

12. The roof component as claimed in claim 4, wherein the transitional beam and each of the plurality of middle camber beams are an integrated molding structure.

13. The roof component as claimed in claim 3, wherein sections of the middle camber beams and/or the end camber beams are Z-shaped along a width direction of the roof component.

14. The roof component as claimed in claim 4, wherein sections of the middle camber beams and/or the end camber beams are Z-shaped along a width direction of the roof component.

15. The roof component as claimed in claim 2, further comprising a roof body, the camber beam component being used for supporting the roof body.

16. The roof component as claimed in claim 3, further comprising a roof body, the camber beam component being used for supporting the roof body.

17. The roof component as claimed in claim 4, further comprising a roof body, the camber beam component being used for supporting the roof body.

18. A railway vehicle, comprising a roof component and a side wall component connected with the roof component, wherein the roof component is the roof component as claimed in claim 1.

19. A railway vehicle, comprising a roof component and a side wall component connected with the roof component, wherein the roof component is the roof component as claimed in claim 2.

20. A railway vehicle, comprising a roof component and a side wall component connected with the roof component, wherein the roof component is the roof component as claimed in claim 3.

* * * * *